US006763864B2

(12) United States Patent
Setlack et al.

(10) Patent No.: US 6,763,864 B2
(45) Date of Patent: Jul. 20, 2004

(54) LOG SPLITTER ATTACHMENT

(76) Inventors: William Setlack, 135 Dawson Road, Ste. Anne, Manitoba (CA), R5H 1B4; Willis Setlack, 135 Dawson Road, Ste. Anne, Manitoba (CA), R5H 1B4

( * ) Notice: Subject to any disclaimer, the term of this patent is extended or adjusted under 35 U.S.C. 154(b) by 0 days.

(21) Appl. No.: 10/439,226

(22) Filed: May 16, 2003

(65) Prior Publication Data

US 2003/0230360 A1 Dec. 18, 2003

(51) Int. Cl.[7] ..... B27L 7/06
(52) U.S. Cl. ..... 144/195.1; 144/193.2
(58) Field of Search ..... 144/192, 193.1, 144/195.2, 195.6, 195.8, 195.1, 193.2, 195.3, 195.7

(56) References Cited

U.S. PATENT DOCUMENTS

| | | | | |
|---|---|---|---|---|
| 4,155,385 A | | 5/1979 | Lapointe | |
| 4,246,942 A | | 1/1981 | Malik | |
| 4,374,532 A | | 2/1983 | Region | |
| 4,432,402 A | | 2/1984 | Wirsbinski | |
| 4,444,231 A | | 4/1984 | Dillon | |
| 4,453,580 A | | 6/1984 | Patten | |
| 4,454,899 A | | 6/1984 | Myers, Jr. | |
| 4,506,712 A | | 3/1985 | Johnson | |
| 4,615,367 A | | 10/1986 | Crowley, Jr. | |
| 6,408,907 B1 | * | 6/2002 | Lantz | 144/195.1 |
| 6,520,226 B1 | * | 2/2003 | Smith | 144/366 |
| 6,609,547 B1 | * | 8/2003 | Machkovech | 144/366 |
| 2003/0155037 A1 | * | 8/2003 | Alexander | 144/195.1 |

* cited by examiner

*Primary Examiner*—Allen Ostrager
*Assistant Examiner*—Shelley Self
(74) *Attorney, Agent, or Firm*—Ryan W. Dupuis; Adrian D. Battison; Michael R. Williams

(57) ABSTRACT

A log splitter attachment is provided for splitting logs on a loader including a pair of lift arms for supporting a bucket. The attachment comprises a frame supporting a blade and a log pusher thereon for sliding movement relative to one another and an actuator acting between the blade and the log pusher. The frame mounts on respective free ends of the lift arms of the loader in place of the bucket of the loader so that the blade and log pusher can be manoeuvred overtop a log on the ground to split the log therebetween using the lift arm and bucket controls of the loader.

17 Claims, 3 Drawing Sheets

LOG SPLITTER ATTACHMENT

FIELD OF THE INVENTION

The present invention relates to a log splitter attachment for a loader and a method of use of the attachment for splitting logs with a loader.

BACKGROUND

The use of a log splitter supported on a loader is known for portability and for the convenience of using the existing hydraulic systems of the loader. Typically these log splitters are intended to act independently of the loader and require manually loading the logs onto the splitter. This can be considerably labour intensive when numerous logs are to be split as some logs can be heavy for an operator to lift onto the splitter. Examples of splitters which require manual loading include U.S. Pat. No. 4,155,385 to Lapointe, U.S. Pat. No. 4,246,942 to Malik, U.S. Pat. No. 4,374,532 to Region, U.S. Pat. No. 4,432,402 to Wirsbinski, U.S. Pat. No. 4,444,231 to Dillon and U.S. Pat. No. 4,453,580 to Patten.

Some other splitters can be mounted to the hitch of a tractor or the like, but are limited in their ability to be manoeuvred as tractors typically do not have readily moveable lift arms. Examples of hitch mounted type splitters include U.S. Pat. No. 4,454,899 to Myers, Jr., and U.S. Pat. No. 4,506,712 to Johnson.

U.S. Pat. No. 4,615,367 to Crowley, Jr. provides a log splitter which includes a complex linkage for specifically mounting the splitter on a backhoe arm using existing hydraulics of the backhoe arm. Use of the splitter on the backhoe arm is awkward however due to obstruction of an operator's view of the splitter by the backhoe itself upon which the splitter is supported. The splitter is further limited in its manoeuvrability due to the fixed orientation of the splitter relative to the backhoe arm.

SUMMARY

According to one aspect of the present invention there is provided a log splitter attachment for a loader including a pair of lift arms for supporting a bucket thereon, the attachment comprising:

- a frame for securement to the lift arms of the loader, the frame including mounting means for mounting the frame in place of the bucket on the lift arms;
- a blade supported on the frame for splitting a log thereon;
- a log pusher supported on the frame and being movable relative to the blade; and
- an actuator acting between the blade and the log pusher for displacing the log pusher relative to the blade between a loading position spaced from the blade and a splitting position in which the log pusher is nearer to the blade than the loading position for urging a log into the blade.

The arrangement of the frame to mount on the lift arms of the loader in place of the bucket of the loader enables the blade and log pusher to be readily manoeuvred overtop a log on the ground to split the log therebetween using the lift arm and bucket controls of the loader. Supporting the attachment on the lift arms of a loader provides greater visibility of the splitter to an operator of the loader for controlling operation of the log splitter more readily as compared to a backhoe attachment. Positioning the splitter in place of the bucket of the loader further enables existing hydraulic controls, for controlling tilt of the bucket relative to the lift arms, to be used for manoeuvring the splitter onto a log to be split by an operator of the loader.

The mounting means may comprise a mounting member which is arranged to mount between respective free ends of the lift arms of the loader.

The actuator preferably comprises a hydraulic piston cylinder for connection to a hydraulic system of the loader.

When provided in combination with a skid steer loader in which lift arms are pivotally supported on opposing sides of an operator compartment, the frame of the log splitter attachment is preferably mounted on respective free ends of the lift arms.

The mounting means may comprise a plate member mounted in place of a bucket of the skid steer loader.

When the plate is arranged for securement across respective-free ends, of the lift arms, a beam preferably extends outwardly from the plate, transversely thereto, for supporting the blade and the log pusher thereon, spaced outwardly from the plate.

The beam preferably extends outwardly from the plate at an upward inclination when the plate is in an upright orientation.

The mounting means may be arranged to support the frame on the lift arms of the loader for relative pivotal movement therebetween.

The beam preferably supports the blade and the log pusher on one side thereof such that access to a working area between the blade and the log pusher is unrestricted from below and from only one of two sides of the working area extending between the blade and the log pusher due to the beam extending across the other side of the working area. The working area between the blade and the log pusher in this arrangement is open along a top and along a bottom thereof.

Preferably, the beam slidably supports a collar of mating cross section there along so that the beam supports one of the blade and the log pusher thereon while the collar supports the other of the blade and the log pusher thereon.

The log pusher is preferably supported on the collar for sliding movement relative to the blade which is fixedly supported on the beam.

The frame may include a plurality brace members mounted between the mounting means and the beam of the frame.

The log pusher preferably comprises a plate member having a textured gripping surface facing the blade.

According to a further aspect of the present invention there is provided a method of splitting logs on a loader including a pair of lift arms for supporting a bucket thereon, the method comprising:

- providing a log splitter attachment comprising a frame supporting a blade and a log pusher thereon for sliding movement relative to one another and an actuator acting between the blade and the log pusher;
- mounting the frame on respective free ends of the lift arms of the loader in place of the bucket of the loader;
- placing a log between the blade and the log pusher; and
- urging the log pusher towards the blade to split the log over the blade by use of the actuator acting between the blade and the log pusher.

When the frame includes a beam supporting the blade and the log pusher for movement relative to one another along one side of the beam, the method preferably includes placing the log between the blade and the log pusher by sweeping the beam across the ground into engagement with a log supported on the ground.

When the frame includes a beam supporting the blade and the log pusher to extend laterally outward from one side thereof, the method preferably also includes orienting the beam parallel to the ground such that a working area between the blade and the log pusher is accessible through a top, a bottom and only one of two sides thereof.

BRIEF DESCRIPTION OF THE DRAWINGS

In the accompanying drawings, which illustrate an exemplary embodiment of the present invention.

DETAILED DESCRIPTION

Figure 1:
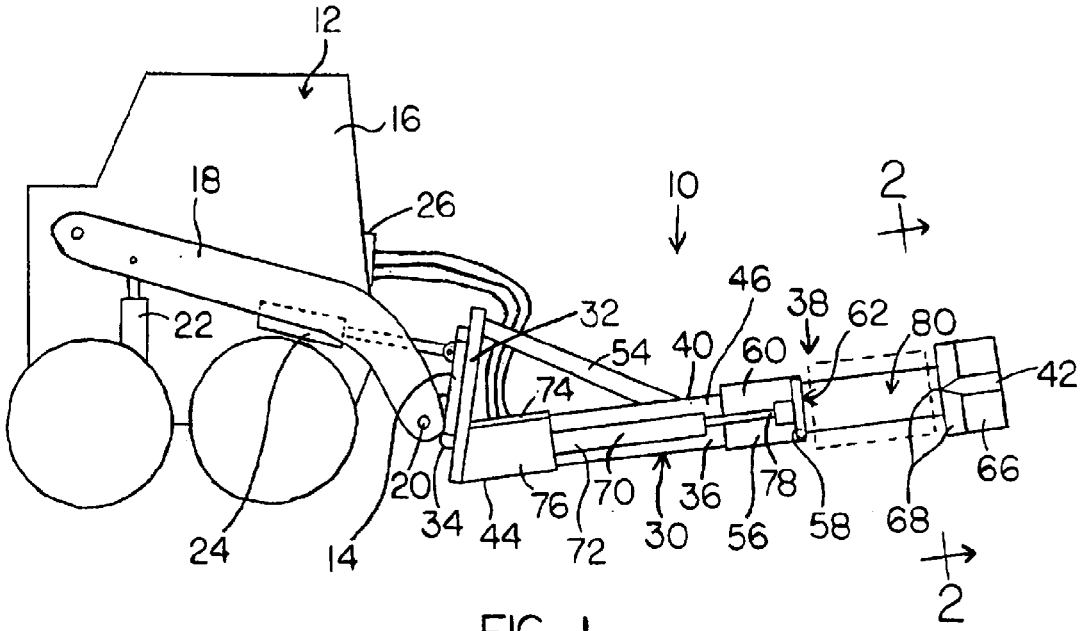
FIG. 1 is a side elevational view of the log splitter attachment shown supported on the bucket mount of a skid steer loader.
Figure 2:
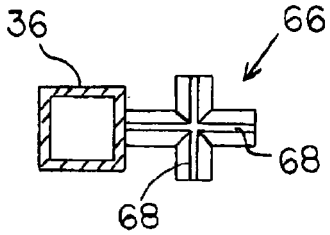
FIG. 2 is a sectional view along the line 2—2 of FIG. 1.
Figure 3:
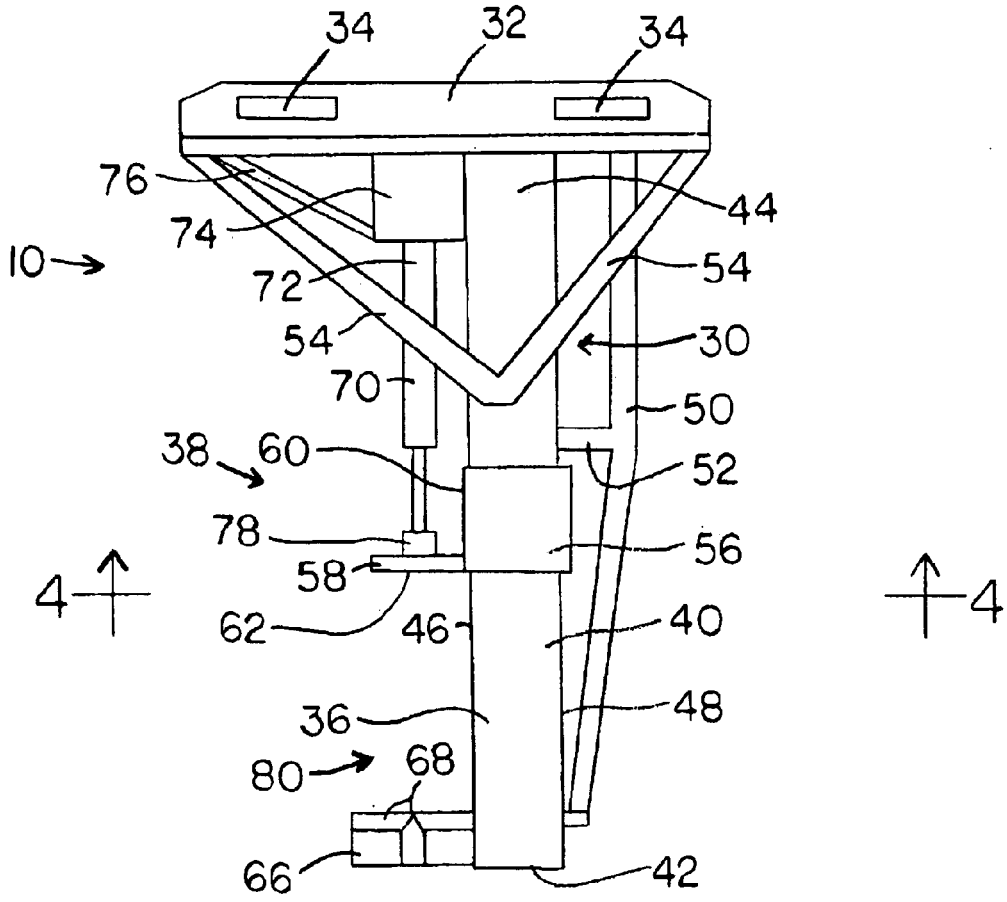
FIG. 3 is a top plan view of the log splitter attachment.
Figure 4:
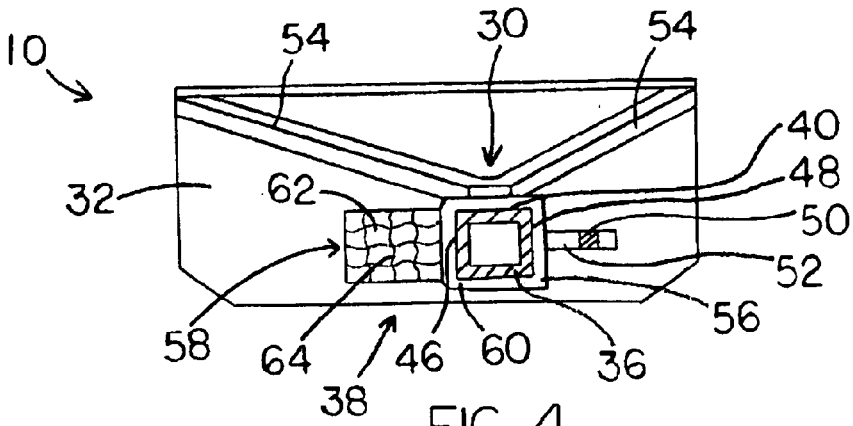
FIG. 4 is a partly sectional view along the line 4—4 of FIG. 3.
Figure 5:
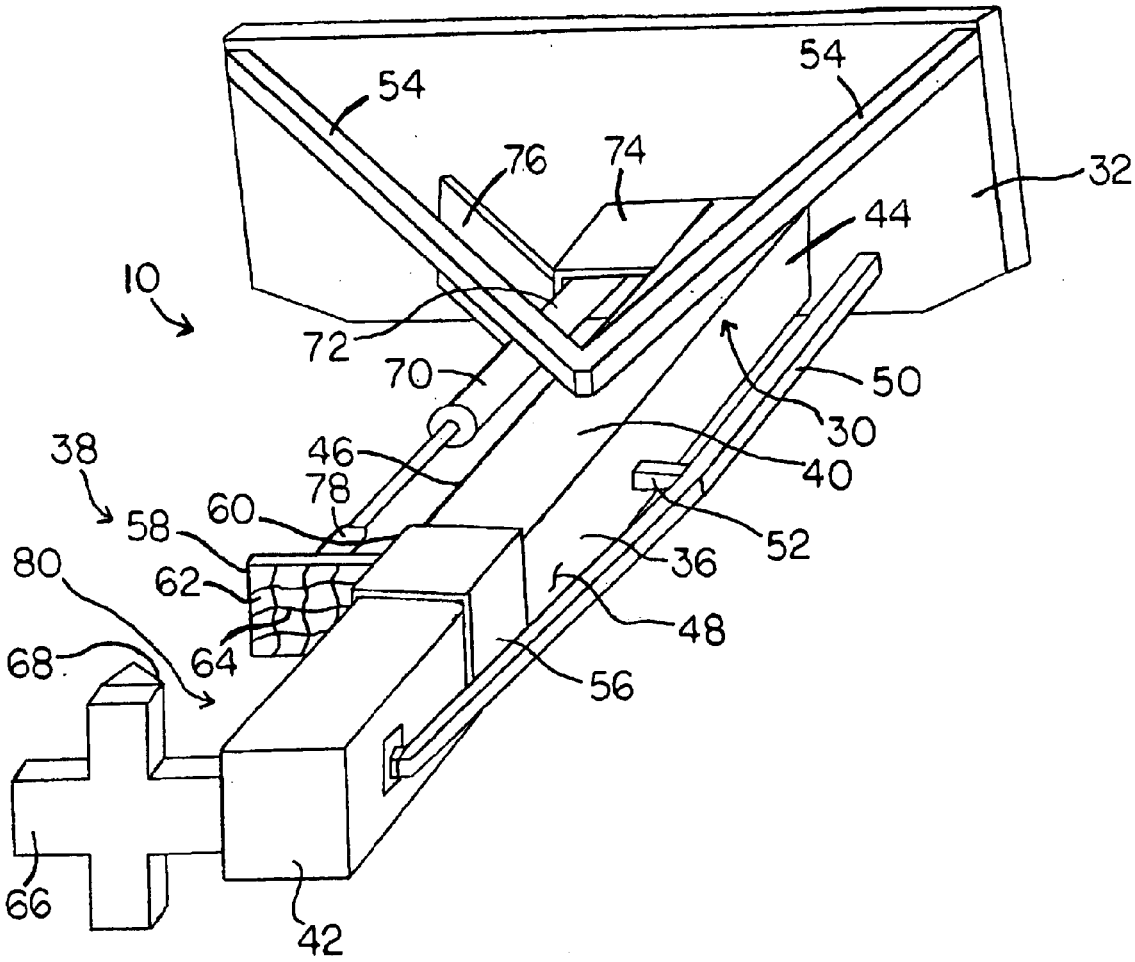
FIG. 5 is an isometric view of the log splitter attachment.

Referring to the accompanying drawings, there is illustrated a log splitter attachment generally indicated at reference numeral 10. The attachment 10 is suitably arranged for being supported on a loader 12, and more particularly on the bucket mount 14 of a skid steer loader in place of the bucket normally supported thereon.

The skid steer loader 12 generally includes an occupant compartment 16 which is centrally located on a frame of the vehicle. The frame includes a pair of lift arms 18 pivotally supported at respective rear ends thereof on the rear end of the frame on opposing sides of the occupant compartment 16. The lift arms 18 extend forwardly and downwardly to respective free ends 20 which pivotally support the bucket mount 14 thereon. The loader includes lifting hydraulic actuators 22 acting between the vehicle frame and the lift arms 18 as well as tilting hydraulic actuators 24 acting between the lift arms 18 and the bucket mount 14 for controlling tilt of the bucket mount relative to the lift arms. The loader further includes an auxiliary hydraulic connection 26 for connection to hydraulic components of the log splitter attachment 10.

The attachment 10 includes a frame 30 which is suitably arranged for mounting on the bucket mount 14 of the loader. The frame includes a mounting plate 32 in the form of a flat, generally rectangular plate which is suitably sized to span between the free ends of the lift arms when mounted on the bucket mount 14. The mounting plate 32 includes a suitable bracket 34 on a rear side thereof for bolting onto the bucket mount 14 of the loader in a manner so that the attachment remains selectively separable from the loader for replacement of the bucket if desired.

When the mounting plate 32 of the attachment 10 is supported on the bucket mount 14, the attachment replaces the bucket so that hydraulic actuators 24 for controlling the tilt of the bucket relative to the lift arms will instead control pivotal movement of the attachment 10 relative to the lift arms about a horizontal pivot axis extending between the free ends of the lift arms upon which the bucket mount 14 is pivotally supported.

The frame further includes a beam 36 mounted on the mounting plate 32 for supporting a log splitting mechanism 38 thereon. The beam lies transversely to the mounting plate 32 in a generally vertical plane extending perpendicularly from the mounting plate 32. A top side 40 of the beam and the mounting plate 32 lie at an acute angle relative to one another so that the beam 36 extends upwardly at an incline towards a free end 42 thereof when the mounting plate 32 lies in a generally vertical orientation. A base end 44 of the beam 36 is mounted on the mounting plate 32 offset slightly to one side thereof so as to define an inner side 46 of the beam which faces towards a center of the mounting plate 32 and an outer side 48 opposite the inner side which faces an outer edge of the plate.

A longitudinal brace 50 is provided along the outer side 48 of the beam spaced outwardly therefrom but generally extending longitudinally therewith from the base end to the free end of the beam. The longitudinal brace 50 is anchored at the free end 42 of the beam and spans at an incline to the beam to an intermediate cross member 52 which anchors the longitudinal brace 50 to the beam at an intermediate position spaced from the beam, between the ends of the beam. A gap between the beam and the longitudinal brace 50, which the cross member 52 spans at the intermediate position of the brace, remains substantially constant along the beam towards the base end 44 thereof where the longitudinal brace 50 is similarly mounted on the mounting plate 32 of the frame.

Two diagonal braces 54 are provided which extend at an upward and outward incline from the intermediate position of the beam to respective spaced positions at opposing top corners of the mounting plate 32. The mounting plate, the beam 36, the longitudinal brace 50 and the diagonal braces 54 are all formed of suitably rigid metallic members which are either solid or hollow in cross section so as to provide sufficient structural rigidity to the frame of the log splitter attachment.

A collar 56 is supported for sliding longitudinal movement along the beam 36 between the free end 42 and the intermediate position of the beam. The collar 56 and the beam 36 have a mating square cross section which permits sliding movement of the collar 56 towards and away from the free end of the beam in a longitudinal direction of the beam.

The collar includes a pusher plate 58 supported thereon which projects from an inner side 60 of the collar, lying in a plane which is generally perpendicular to the longitudinal direction of the beam 36. A front side 62 of the pusher plate 58 faces the free end 42 of the beam while being slidable with the collar along the beam towards and away from the free end thereof. The front side 62 of the plate includes a textured gripping surface in the form of a grid of ribs 64 having an irregular profile for gripping the ends of logs to be split.

A blade 66 is provided in fixed relationship on the free end 42 of the beam 36. The blade is supported on the inner side of the beam so as to be substantially in alignment with the pusher plate 58 on the collar. The blade 66 comprises two intersecting cutting edges projecting rearwardly so as to confront the front side of the pusher plate 58. The cutting edges 68 intersect one another in a generally cross shape in which one of the edges is generally vertically oriented spaced inwardly from the inner side of the beam and one of the cutting edges extends generally horizontally perpendicularly to the vertical cutting edge to project from the inner side of the beam. Both cutting edges 68 lie in a generally common plane which is parallel to the front side 62 of the pusher plate 58.

An actuator 70 is provided in the form of a hydraulic piston cylinder configuration which is connected to the auxiliary hydraulic connection 26 of the loader for controlling operation thereof. The actuator 70 acts between the pusher plate 58 and the blade 66 to control displacement of the pusher plate 58 towards and away from the blade 66. A cylinder end 72 of the actuator is anchored within a collar 74 adjacent the base end 44 of the beam on the mounting plate 32. A suitable brace 76 couples between the collar 74 and the mounting plate 32 to ensure the cylinder end 72 of the actuator is securely anchored to the mounting plate 32.

A piston end 78 of the actuator 70 is supported on a rear side of the pusher plate 58 opposite the front side 62 which confronts the blade 66. The piston end 78 of the actuator is mounted centrally on the pusher plate 58 to evenly push the plate 58 away from the mounting plate 32 between a loading position and a splitting position. In the loading position, the pusher plate is spaced outwardly from the mounting plate 32 part way along the beam 36 but spaced from the free end 42 of the beam sufficiently so as to receive a log between the pusher plate 58 and the blade 66. In the splitting position, the pusher plate 58 is slidably displaced in the longitudinal direction of the beam, spaced further from the mounting plate towards the blade 66 at the free end of the beam in relation to the loading position.

In this arrangement the working area 80 between the pusher plate 58 and the blade 66, which receives a log to be split therebetween, is enclosed only along one side by the beam 36 extending therealong due to the side mounted configuration of the splitter. The working area however remains open and unrestricted along the top, the bottom and the other side of the working area 80 extending between the pusher plate 58 and the blade 66. Logs in this instance can be readily picked up by the log splitter attachment 10 by an operator of the loader by either lowering the attachment over top of a log lying on the ground or by sweeping the beam 36 generally horizontally across the ground, parallel to the ground into sideways engagement with a log supported on the ground. In either instance, the beam can be oriented parallel to the ground so that the working area between the blade and pusher plate also extends parallel to the ground for accepting a log lying on the ground in use.

The log splitter attachment 10 is particularly useful as only a single operator is required for controlling displacement of the loader about a work site and for loading logs into the log splitter attachment. For operation of the log splitter attachment, the bucket of a skid steer loader 12 is first removed and replaced with the log splitter attachment 10 which readily secures to the bucket mount 14 of the loader. The hydraulics of the actuator 70 are then coupled to the auxiliary hydraulic connections 26 of the loader to permit operation of the attachment from the controls within the operator compartment 16 of the loader. Centrally locating the beam on the mounting plate 32 ensures adequate visibility to an operator of the loader because the beam is positioned between the lift arms of the loader instead of being obstructed from view by one of the lift arms. Furthermore positioning of the pusher plate 58 and the blade 66 to extend longitudinally outward spaced outward from the mounting plate provides further visibility to the operating components of the log splitter attachment by an operator of the loader. The upward inclination of the beam in relation to the mounting plate 32 permits the beam to be lowered substantially horizontally along the ground by using the bucket controls to tilt the bucket mount and mounting plate 32 supported thereon forwardly. In this position, pivoting movement of the loader relative to the ground permits the beam to be swept across the ground for engagement with logs. Once a log is engaged with the inner side of the beam, the actuator 70 may be actuated to push the plate 58 towards the blade 66 for gripping a log therebetween. Once a log is gripped, the loader controls may be used to raise the lift arms 18 and tilt the bucket mount 14 forwardly thereon so that the beam projects outwardly from the loader spaced high above the ground for splitting the log overtop a designated cut pile of split logs or overtop the bed of a truck within which split logs are to be collected.

While one embodiment of the present invention has been described in the foregoing, it is to be understood that other embodiments are possible within the scope of the invention. In the illustrated embodiment for example, a right-hand side mounted configuration as Viewed from the operator controls of the loader is shown, however the blade and log pusher can also be readily supported on the opposing side of the beam in a left-hand side mounted configuration in which the left-hand side mounted configuration comprises a mirror image of the illustrated embodiment and accordingly would function in an identical manner. The invention is to be considered limited solely by the scope of the appended claims.

What is claimed is:

1. A log splitter attachment for a loader including a pair of lift arms for supporting a bucket thereon, the attachment comprising:

a frame for securement to the lift arms of the loader, the frame including mounting means for mounting the frame in place of the bucket on the lift arms;

a blade supported on the frame for splitting a log thereon;

a log pusher supported on the frame and being movable relative to the blade; and an actuator acting between the blade and the log pusher for displacing the log pusher relative to the blade between a loading position spaced from the blade and a splitting position in which the log pusher is nearer to the blade than the loading position for urging a log into the blade;

the frame including a beam supporting the blade and the pusher on one side thereof such that access to a working area between the blade and the log pusher is unrestricted from only one of two sides of the working area extending between the blade and the log pusher, the beam extending across the other side of the working area.

2. The attachment according to claim 1 wherein the mounting means comprises a mounting member which is arranged to mount between respective free ends of the lift arms of the loader.

3. The attachment according to claim 1 wherein the actuator comprises a hydraulic piston cylinder for connection to a hydraulic system of the loader.

4. The attachment according to claim 1 in combination with a skid steer loader in which lift arms are pivotally supported on opposing sides of an operator compartment, the frame being mounted on respective free ends of the lift arms.

5. The attachment according to claim 4 wherein the mounting means comprises a plate member mounted in place of a bucket of the skid steer loader.

6. The attachment according to claim 1 wherein the mounting means comprises a plate for securement across respective free ends of the lift arms, the frame including a beam extending outwardly from the plate, transversely thereto, the blade and the log pusher being supported on the beam.

7. The attachment according to claim 6 wherein the beam extends outwardly from the plate at an upward inclination when the plate is in an upright orientation.

8. The attachment according to claim 1 wherein the mounting means are arranged to support the frame on the lift arms of the loader for relative pivotal movement therebetween.

9. The attachment according to claim 1 wherein the frame includes a beam supporting the blade and the log pusher on one side thereof such that access to a working area between the blade and the log pusher is unrestricted from below.

10. The attachment according to claim 1 wherein the working area between the blade and the log pusher is open along a top and along a bottom thereof.

11. The attachment according to claim 1 wherein the frame includes a beam slidably supporting a collar of mating cross sections there along, the beam supporting one of the blade and the log pusher thereon and the collar supporting the other of the blade and the log pusher thereon.

12. The attachment according to claim 11 wherein the log pusher is supported on the collar for sliding movement relative to the blade which is supported on the beam.

13. The attachment according to claim 11 wherein the frame includes a plurality brace members mounted between the mounting means and the beam of the frame.

14. The attachment according to claim 1 wherein the log pusher comprises a plate member having a textured gripping surface facing the blade.

15. A method of splitting logs on a loader including a pair of lift arms for supporting a bucket thereon, the method comprising:

providing a log splitter attachment comprising a frame supporting a blade and a log pusher thereon for sliding movement relative to one another and an actuator acting between the blade and the log pusher, the frame including a beam supporting the blade and the log pusher to extend laterally outward from one side thereof;

mounting the frame on respective free ends of the lift arms of the loader in place of the bucket of the loader;

placing a log between the blade and the log pusher;

urging the log pusher towards the blade to split the log over the blade by use of the actuator acting between the blade and the log pusher; and orienting the beam parallel to the around such that a working area between the blade and the log pusher is accessible through only one of two sides thereof.

16. The method according to claim 15 including placing the log between the blade and the log pusher by sweeping the beam across the ground into engagement with a log supported on the ground.

17. The method according to claim 15 wherein the working area between the blade and the log pusher is accessible through a top, and a bottom.

* * * * *